US006118968A

United States Patent [19]

Schlueter, Jr. et al.

[11] Patent Number: 6,118,968

[45] **Date of Patent: *Sep. 12, 2000**

[54] INTERMEDIATE TRANSFER COMPONENTS INCLUDING POLYIMIDE AND POLYPHENYLENE SULFIDE LAYERS

[75] Inventors: Edward L. Schlueter, Jr., Rochester; James F. Smith, Ontario, both of N.Y.

[73] Assignee: Xerox Corporation, Stamford, Conn.

[ * ] Notice: This patent is subject to a terminal disclaimer.

[21] Appl. No.: 09/069,713

[22] Filed: Apr. 30, 1998

[51] Int. Cl.[7] ..... G03G 15/14; G03G 15/18; G03G 15/22

[52] U.S. Cl. ..... 399/333; 428/36.9; 428/36.91; 428/409; 428/419; 428/421; 428/422; 428/424.2; 428/424.4; 428/473.5

[58] Field of Search ..... 428/36.9, 36.91, 428/409, 419, 421, 422, 424.2, 424.4, 473.5; 399/307, 333; 522/162, 164

[56] References Cited

U.S. PATENT DOCUMENTS

| | | | |
|---|---|---|---|
| 3,976,370 | 8/1976 | Goel et al. | 355/3 R |
| 5,258,252 | 11/1993 | Sakai et al. | 430/66 |
| 5,272,029 | 12/1993 | Sakai et al. | 430/58 |
| 5,298,956 | 3/1994 | Mammino et al. | 355/275 |
| 5,409,557 | 4/1995 | Mammino et al. | 156/137 |
| 5,525,446 | 6/1996 | Sypula et al. | 430/47 |
| 5,536,352 | 7/1996 | Zeman | 156/242 |
| 5,537,194 | 7/1996 | Henry et al. | 355/271 |
| 5,593,939 | 1/1997 | Saito et al. | 503/227 |
| 5,629,761 | 5/1997 | Theodoulou et al. | 399/307 |
| 5,652,077 | 7/1997 | Obinata | 430/56 |
| 5,761,595 | 6/1998 | Tarnawskyj et al. | 399/308 |
| 5,918,099 | 6/1999 | Schlueter et al. | 399/333 |

*Primary Examiner*—Ellis Robinson
*Assistant Examiner*—Sandra M. Nolan
*Attorney, Agent, or Firm*—Annette Bade

[57] ABSTRACT

A transfer member having a polyimide substrate, an optional solventless intermediate adhesive layer, an outer polyphenylene sulfide layer, and an optional outer release layer, which provides enhanced bonding and decreased occurrence of delamination is provided.

23 Claims, 4 Drawing Sheets

INTERMEDIATE TRANSFER COMPONENTS INCLUDING POLYIMIDE AND POLYPHENYLENE SULFIDE LAYERS

CROSS REFERENCE TO RELATED APPLICATIONS

Attention is directed to application U.S. patent application Ser. No. 09/070,186, filed Apr. 30, 1998 now U.S. Pat. No. 5,918,099, entitled, "Fuser Components with Polyphenylene Sulfide Layer." The disclosure of this application is hereby incorporated by reference in its entirety.

BACKGROUND OF THE INVENTION

The present invention relates to transfer components, and more specifically, to intermediate transfer and transfix components useful in transferring a developed image in an electrostatographic, including xerographic and digital, machine. In embodiments of the present invention, there are selected transfer components comprising an outer layer comprising a polymer, preferably a polyphenylene sulfide. In embodiments, the transfer member comprises a polyimide substrate, an optional solventless adhesive layer and a polyphenylene sulfide outer layer. In embodiments, the transfer layers are corona treated prior to lamination with an adhesive. The present invention, in embodiments, allows for the preparation and manufacture of transfer components with a lower dissipation factor, lower thermal expansion, and higher modulus. Further, in embodiments, the transfer components exhibit excellent properties such as less water and oxygen uptake and excellent electrical properties. Moreover, in embodiments, the transfer components have excellent mechanical properties including improved adhesion and reduced or eliminated delamination.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Generally, the electrostatic latent image is developed by bringing a developer mixture into contact therewith. A dry developer mixture usually comprises carrier granules having toner particles adhering triboelectrically thereto. Toner particles are attracted from the carrier granules to the latent image forming a toner powder image thereon. Alternatively, a liquid developer material may be employed. The liquid developer material includes a liquid carrier having toner particles dispersed therein. The liquid developer material is advanced into contact with the electrostatic latent image and the toner particles are deposited thereon in image configuration. After the toner particles have been deposited on the photoconductive surface, in image configuration, it is transferred to a copy sheet. However, when a liquid developer material is employed, the copy sheet is wet with both the toner particles and the liquid carrier. Thus, it is necessary to remove the liquid carrier from the copy sheet. This may be accomplished by drying the copy sheet prior to fusing of the toner image, or relying upon the fusing process to permanently fuse the toner particles to the copy sheet as well as vaporizing the liquid carrier adhering thereto. It is desirable to refrain from transferring any liquid carrier to the copy sheet. Therefore, it is advantageous to transfer the developed image to a coated intermediate transfer web, belt or component, and subsequently transfer with very high transfer efficiency the developed image from the intermediate transfer component to a permanent substrate. The toner image is usually fixed or fused upon a support which may be the photosensitive member itself or other support sheet such as plain paper.

U.S. Pat. No. 5,525,446 discloses an intermediate transfer member including a base layer and a top thermoplastic film forming polymer layer. Polyphenylene sulfide is an example of the thermoplastic film forming polymer layer.

U.S. Pat. Nos. 5,298,956 and 5,409,557, disclose a seamless intermediate transfer member having a reinforcing member in an endless configuration, a filler material and an electrical property regulating material. The filler material can be a film forming polymer such as polyphenylene sulfide.

U.S. Pat. No. 5,536,352 discloses a method of centrifugal casting comprising the steps of adding a polymeric material to a centrifugal apparatus, centrifuging the polymeric material, removing the cast polymeric material, and mounting the cast to an outside surface of a support. Polyphenylene sulfide is used as a primer or adhesive material in the process of casting conveyor belts for rollers.

It is desired to provide a transfer member which possesses many or all of the qualities required for optimum function. Higher modulus, lower thermal expansion, excellent electrical properties, better flex life and decreased costs are desired properties. Other desired properties include wear resistance, cleanability and seamability. In addition, desirable properties include lower water and oxygen uptake.

SUMMARY OF THE INVENTION

Embodiments of the present invention include: a transfer member comprising a substrate comprising a polyimide, an optional adhesive layer and an outer layer comprising polyphenylene sulfide.

In addition, embodiments include: an image forming apparatus for forming images on a recording medium comprising: a charge-retentive surface to receive an electrostatic latent image thereon; a development component to apply toner to said charge-retentive surface to develop said electrostatic latent image to form a developed image on said charge retentive surface; a transfer component to transfer the developed image from said charge retentive surface to a copy substrate, said transfer member comprising a substrate comprising a polyimide, an optional adhesive layer, and an outer layer comprising polyphenylene sulfide.

Moreover, embodiments include: a transfer member comprising a substrate comprising a polyimide, an adhesive layer positioned thereon wherein said adhesive layer comprises a solventless adhesive, and an outer layer positioned on said adhesive layer wherein said outer layer comprises polyphenylene sulfide, and wherein at least one of said polyimide substrate and said polyphenylene sulfide outer layer are subjected to corona treatment prior to positioning said solventless adhesive between said polyimide substrate and said polyphenylene sulfide outer layer.

BRIEF DESCRIPTION OF THE DRAWINGS

For a better understanding of the present invention, reference may be had to the accompanying figures.

DETAILED DESCRIPTION OF THE PRESENT INVENTION

The present invention relates to transfer members comprising a polyphenylene sulfide outer layer, and, in embodiments, intermediate transfer members and transfix members having a polyimide substrate, optional adhesive layer (preferably a solventless adhesive) and outer polyphenylene sulfide layer. Further, in embodiments, an outer release layer can be provided on the polypropylene sulfide outer layer. In addition, in embodiments, at least one of the substrate and outer layer(s) is subjected to corona treatment prior to lamination with an adhesive.

Figure 1:
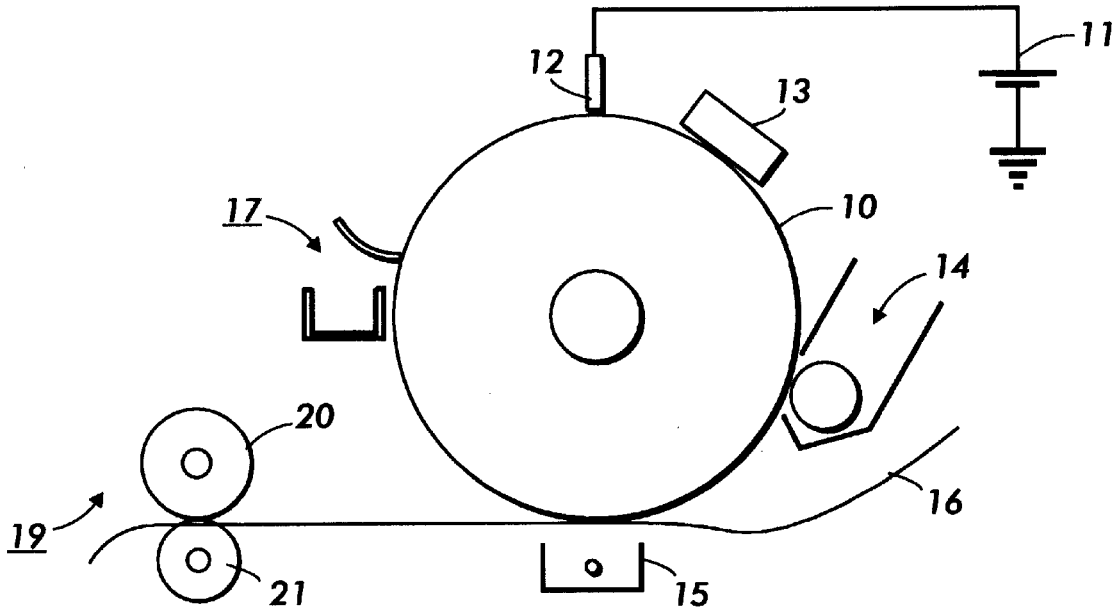
FIG. 1 is a schematic illustration of an image apparatus in accordance with the present invention.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 16 advances to fusing station 19, depicted in FIG. 1 as fuser roll 20 and pressure roll 21 (although any other fusing components such as fuser belt in contact with a pressure roll, fuser roll in contact with pressure belt, and the like, are suitable for use with the present apparatus), wherein the developed image is fused to copy sheet 16 by passing copy sheet 16 between the fusing and pressure members, thereby forming a permanent image. Alternatively, transfer and fusing can be effected by a transfix application.

Photoreceptor 10, subsequent to transfer, advances to cleaning station 17, wherein any toner left on photoreceptor 10 is cleaned therefrom by use of a blade (as shown in FIG. 1), brush, or other cleaning apparatus.

The transfer members employed for the present invention can be of any suitable configuration. Examples of suitable configurations include a sheet, a film, a web, a foil, a strip, a coil, a cylinder, a drum, an endless mobius strip, a circular disc, a belt including an endless belt, an endless seamed flexible belt, an endless seamless flexible belt, an endless belt having a puzzle cut seam, and the like.

The transfer components of the instant invention may be employed in either an image on image transfer or a tandem transfer of a toned image(s) from the photoreceptor to the intermediate transfer component, or in a transfix system for simultaneous transfer and fusing the transferred and developed latent image to the copy substrate. In an image on image transfer, the color toner images are first deposited on the photoreceptor and all the color toner images are then transferred simultaneously to the intermediate transfer component. In a tandem transfer, the toner image is transferred one color at a time from the photoreceptor to the same area of the intermediate transfer component.

Transfer of the developed image from the imaging member to the intermediate transfer element and transfer of the image from the intermediate transfer element to the substrate can be by any suitable technique conventionally used in electrophotography, such as corona transfer, pressure transfer, bias transfer, and combinations of those transfer means, and the like. In the situation of transfer from the intermediate transfer medium to the substrate, transfer methods such as adhesive transfer, wherein the receiving substrate has adhesive characteristics with respect to the developer material, can also be employed. Typical corona transfer entails contacting the deposited toner particles with the substrate and applying an electrostatic charge on the surface of the substrate opposite to the toner particles. A single wire corotron having applied thereto a potential of between about 5,000 and about 8,000 volts provides satisfactory transfer. In a specific process, a corona generating device sprays the back side of the image receiving member with ions to charge it to the proper potential so that it is tacked to the member from which the image is to be transferred and the toner powder image is attracted from the image bearing member to the image receiving member. After transfer, a corona generator charges the receiving member to an opposite polarity to detach the receiving member from the member that originally bore the developed image, whereupon the image receiving member is separated from the member that originally bore the image.

For color imaging, typically, four image forming devices are used. The image forming devices may each comprise an image receiving member in the form of a photoreceptor of other image receiving member. The intermediate transfer member of an embodiment of the present invention is supported for movement in an endless path such that incremental portions thereof move past the image forming components for transfer of an image from each of the image receiving members. Each image forming component is positioned adjacent the intermediate transfer member for enabling sequential transfer of different color toner images to the intermediate transfer member in superimposed registration with one another.

The intermediate transfer member moves such that each incremental portion thereof first moves past an image forming component and comes into contact with a developed color image on an image receiving member. A transfer device, which can comprise a corona discharge device, serves to effect transfer of the color component of the image at the area of contact between the receiving member and the intermediate transfer member. In a like fashion, image components of colors such as red, blue, brown, green, orange, magenta, cyan, yellow and black, corresponding to the original document also can be formed on the intermediate transfer member one color on top of the other to produce a full color image.

A transfer sheet or copy sheet is moved into contact with the toner image on the intermediate transfer member. A bias transfer member may be used to provide good contact between the sheet and the toner image at the transfer station. A corona transfer device also can be provided for assisting the bias transfer member in effecting image transfer. These imaging steps can occur simultaneously at different incremental portions of the intermediate transfer member. Further details of the transfer method employed herein are set forth in U.S. Pat. No. 5,298,956 to Mammino, the disclosure of which is hereby incorporated by reference in its entirety.

The intermediate transfer member herein can be employed in various devices including, but not limited to, devices described in U.S. Pat. Nos. 3,893,761; 4,531,825; 4,684,238; 4,690,539; 5,119,140; and 5,099,286; the disclosure of all of which are hereby incorporated by reference in their entirety.

Figure 2:
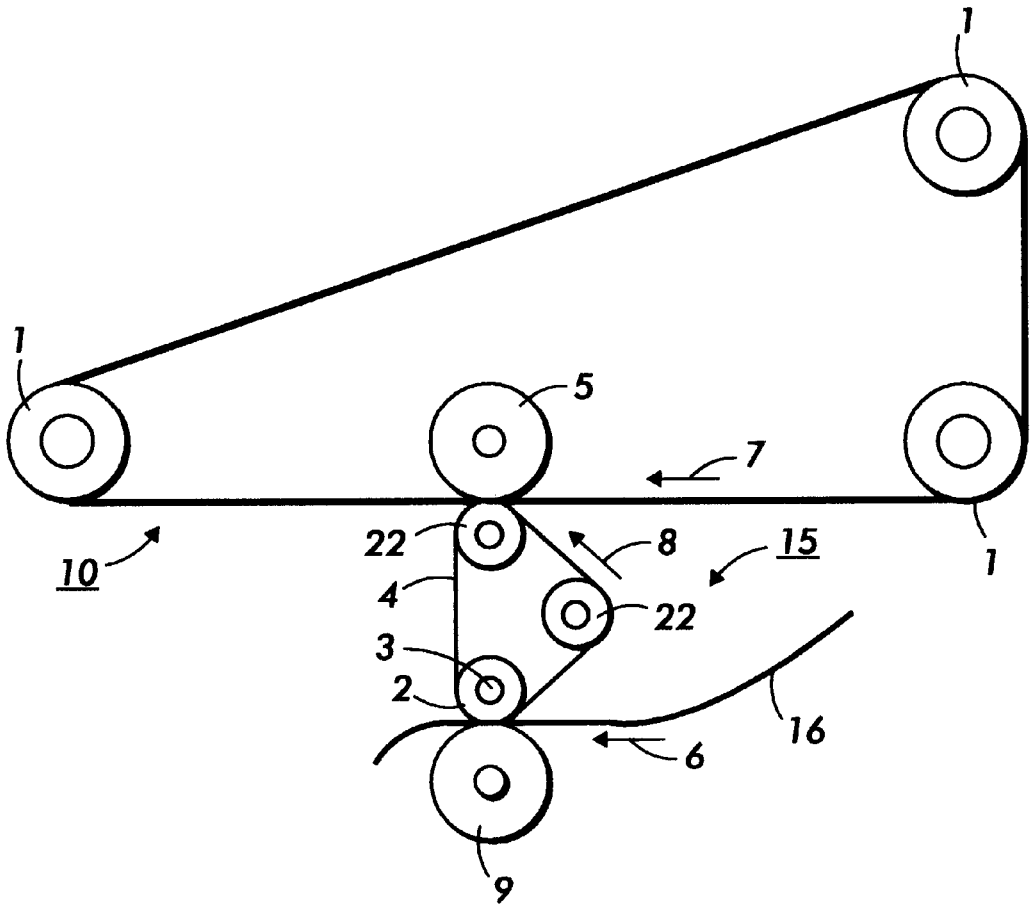
FIG. 2 is an illustration of an embodiment of the present invention, and represents a transfix member.

Transfer and fusing may occur simultaneously in a transfix configuration. As shown in FIG. 2, a transfer apparatus 15 is depicted as transfix belt 4 being held in position by driver rollers 22 and heated roller 2. Heated roller 2 comprises a heater element 3. Transfix belt 4 is driven by driving rollers 22 in the direction of arrow 8. The developed image from photoreceptor 10 (which is driven in direction 7 by rollers 1) is transferred to transfix belt 4 when contact with photoreceptor 10 and belt 4 occurs. Pressure roller 5 aids in transfer of the developed image from photoreceptor 10 to transfix belt 4. The transferred image is subsequently transferred to copy substrate 16 and simultaneously fixed to copy substrate 16 by passing the copy substrate 16 between belt 4 (containing the developed image) and pressure roller 9. A nip is formed by heated roller 2 with heating element 3 contained therein and pressure roller 9. Copy substrate 16 passes through the nip formed by heated roller 2 and pressure roller 9, and simultaneous transfer and fusing of the developed image to the copy substrate 16 occurs.

Figure 3:
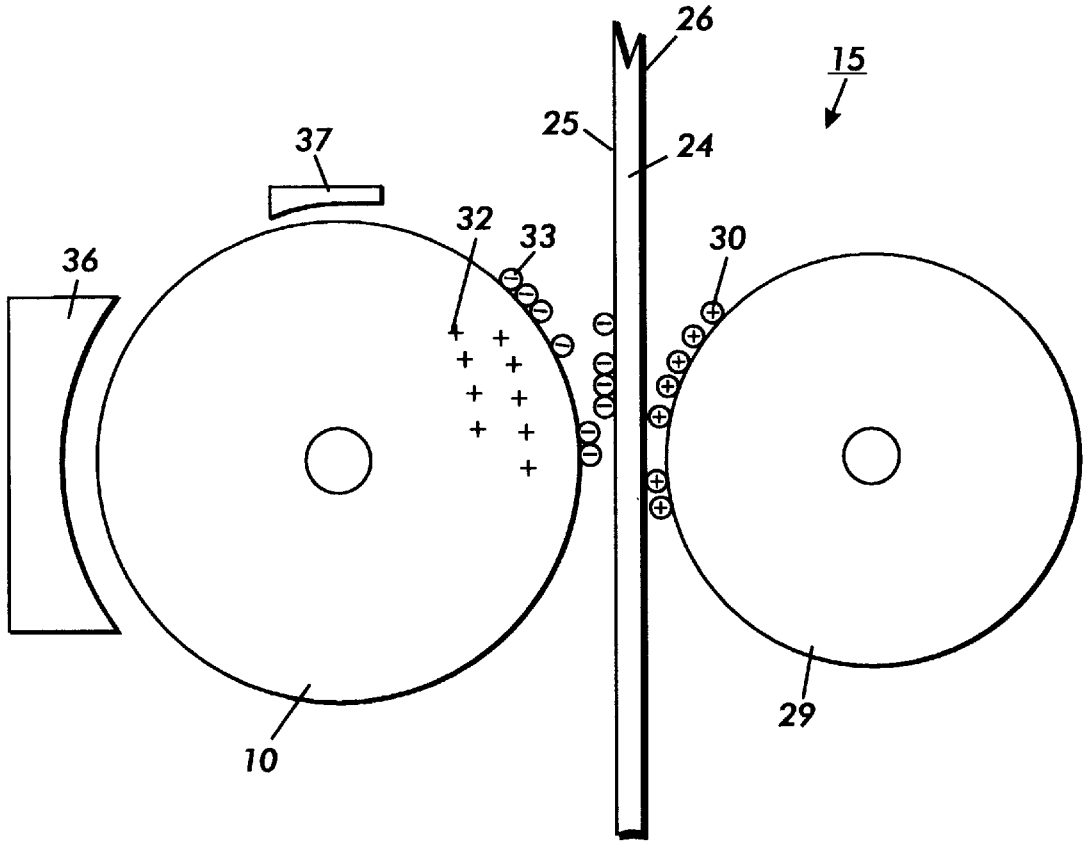
FIG. 3 is a schematic view of an image development system containing an intermediate transfer member.

FIG. 3 demonstrates another embodiment of the present invention and depicts a transfer apparatus 15 comprising an intermediate transfer member 24 positioned between an imaging member 10 and a transfer roller 29. The imaging member 10 is exemplified by a photoreceptor drum. However, other appropriate imaging members may include other electrostatographic imaging receptors such as ionographic belts and drums, electrophotographic belts, and the like.

In the multi-imaging system of FIG. 3, each image being transferred is formed on the imaging drum by image forming station 36. Each of these images is then developed at developing station 37 and transferred to intermediate transfer member 24. Each of the images may be formed on the photoreceptor drum 10 and developed sequentially and then transferred to the intermediate transfer member 24. In an alternative method, each image may be formed on the photoreceptor drum 10, developed, and transferred in registration to the intermediate transfer member 24. In a preferred embodiment of the invention, the multi-image system is a color copying system. In this color copying system, each color of an image being copied is formed on the photoreceptor drum. Each color image is developed and transferred to the intermediate transfer member 24. As above, each of the colored images may be formed on the drum 10 and developed sequentially and then transferred to the intermediate transfer member 24. In the alternative method, each color of an image may be formed on the photoreceptor drum 10, developed, and transferred in registration to the intermediate transfer member 24.

After latent image forming station 36 has formed the latent image on the photoreceptor drum 10 and the latent image of the photoreceptor has been developed at developing station 37, the charged toner particles 33 from the developing station 37 are attracted and held by the photoreceptor drum 10 because the photoreceptor drum 10 possesses a charge 32 opposite to that of the toner particles 33. In FIG. 3, the toner particles are shown as negatively charged and the photoreceptor drum 10 is shown as positively charged. These charges can be reversed, depending on the nature of the toner and the machinery being used. In a preferred embodiment, the toner is present in a liquid developer. However, the present invention, in embodiments, is useful for dry development systems also.

A biased transfer roller 29 positioned opposite the photoreceptor drum 10 has a higher voltage than the surface of the photoreceptor drum 10. As shown in FIG. 3, biased transfer roller 29 charges the backside 26 of intermediate transfer member 24 with a positive charge. In an alternative embodiment of the invention, a corona or any other charging mechanism may be used to charge the backside 26 of the intermediate transfer member 24.

The negatively charged toner particles 33 are attracted to the front side 25 of the intermediate transfer member 24 by the positive charge 30 on the backside 26 of the intermediate transfer member 24.

The intermediate transfer member may be in the form of a sheet, web or belt as it appears in FIG. 3, or in the form of a roller or other suitable shape. In a preferred embodiment of the invention, the intermediate transfer member is in the form of a belt. In another embodiment of the invention, not shown in the figures, the intermediate transfer member may be in the form of a sheet.

Figure 4:
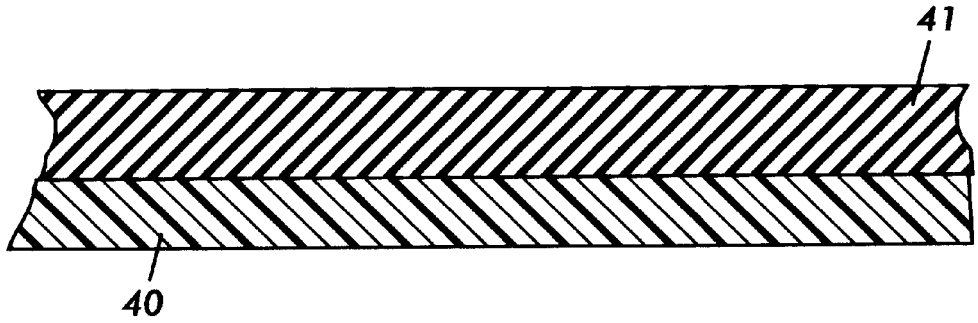
FIG. 4 is an illustration of an embodiment of the invention, wherein a two layer transfer film comprising a substrate and an outer polyphenylene sulfide layer as described herein is shown.

FIG. 4 demonstrates a two layer configuration of an embodiment of the present invention. Included therein is a substrate 40 and outer polyphenylene sulfide layer 41. Preferably, the substrate is comprised of a suitable high elastic modulus material such as a polyimide material. The material should be capable of becoming conductive upon the addition of electrically conductive particles. A polyimide having a high elastic modulus is preferred because the high elastic modulus optimizes the stretch registration and transfer or transfix conformance. The polyimide used herein has the advantages of improved flex life and image registration, chemical stability to liquid developer or toner additives, thermal stability for transfix applications and for improved overcoating manufacturing, improved solvent resistance as compared to known materials used for film for transfer components.

Suitable polyimides include those formed from various diamines and dianhydrides, such as poly(amide-imide), polyetherimide, siloxane polyetherimide block copolymer such as, for example, SILTEM STM-1300 available from General Electric, Pittsfield, Mass., and the like. Preferred polyimides include aromatic polyimides such as those formed by the reacting pyromellitic acid and diaminodiphenylether sold under the tradename KAPTON®-type-HN, available from DuPont. Another suitable polyimide available from DuPont and sold as KAPTON®-Type-FPC-E, is produced by imidization of copolymeric acids such as biphenyltetracarboxylic acid and pyromellitic acid with two aromatic diamines such as p-phenylenediamine and diaminodiphenylether. Another suitable polyimide includes pyromellitic dianhydride and benzophenone tetracarboxylic dianhydride copolymeric acids reacted with 2,2-bis[4-(8-aminophenoxy)phenoxy]-hexafluoropropane available as EYMYD type L-20N from Ethyl Corporation, Baton Rouge, La. Other suitable aromatic polyimides include those containing 1,2,1',2'-biphenyltetracarboximide and paraphenylene groups such as UPILEX®-S available from Uniglobe Kisco, Inc., White Planes, N.Y., and those having biphenyltetracarboximide functionality with diphenylether end spacer characterizations such as UPILEX®-R also available from Uniglobe Kisco, Inc. Mixtures of polyimides can also be used.

The polyimide is present in the film in an amount of from about 60 to about 99.9 percent by weight of total solids, preferably from about 80 to about 90 percent by weight of total solids. Total solids as used herein includes the total percentage by weight of polymer, conductive fillers and any additives in the layer.

It is preferred that the polyimide contain a resistive filler such as carbon black, graphite, boron nitride, metal oxides such as copper oxide, zinc oxide, titanium dioxide, silicone dioxide, and the like. The outer layer(s) such as the polyphenylene sulfide outer layer and optional outer release layer, can also comprise a filler such as those just listed. The polyimide substrate can also comprise known additives.

The outer layer 41 of the transfer member herein is preferably polyphenylene sulfide. Any known and/or commercially available polyphenylene sulfide may be used as the outer layer of the transfer member. Polyphenylene sulfide is a polymer composed of a series of alternating aromatic rings and sulfur atoms. Polyphenylene sulfide can be prepared through the synthesis of 1,4-dichlorobenzene and sodium sulfide. Polyphenylene sulfide combines favorable electrical characteristics with high thermal stability and chemical resistance. Preferred examples of polyphenylene sulfides include those sold under the tradename TORELINA®, available from Toray Marketing & Sales (America), Inc., New York, N.Y.; RYTON™ available from ICI Films of Wilmington, Del. and Toray Industries, and the like.

The polyphenylene sulfide provides preferable results as compared to known materials such as polyimide, polyester and polycarbonate, useful as outer layers of transfer members. For example, polyphenylene sulfide has a greater modulus (from about 200,000 to about 750,000, preferably from about 400,000 to about 550,000 PSI for polyphenylene sulfide as compared to from about 150,000 to about 350,000 PSI for polycarbonate), lower cost, and lower water absorption (0.05 percent for polyphenylene sulfide as compared to 0.25 to 2.2 percent for polyimide). These properties are important for stability of the mechanical, electrical and chemical properties during function in xerographic processes. Another superior property of polyphenylene sulfide is that it is a high temperature thermal plastic material. This is important in that a thermal set material is harder to seam. Moreover, polyphenylene sulfide is more temperature resistant than polyesters. Polyphenylene sulfide has been shown to have lower friction and lower wear rates than polyimides. In addition, polyphenylene sulfide has been shown to exhibit easier toner cleanability than polyimide. For example, toner removal tests have shown that air velocity of about 107 ft/sec was required to remove toner from a polyimide material. When polyphenylene sulfide was tested under the same conditions, a lower air velocity of about 87 ft/sec was required to remove toner from the material surface. Tests such as these demonstrate that the polyphenylene sulfide surface provides a surface which exhibits easier toner cleanability than polyimide.

The polyphenylene sulfide is present in the outer layer in an amount of from about 60 to about 99.9, and preferably from about 80 to about 90 percent by weight of total solids. Total solids as used herein refers to the total amount of solid material in the layer, including polymer, filler, additives and other solids.

Figure 5:
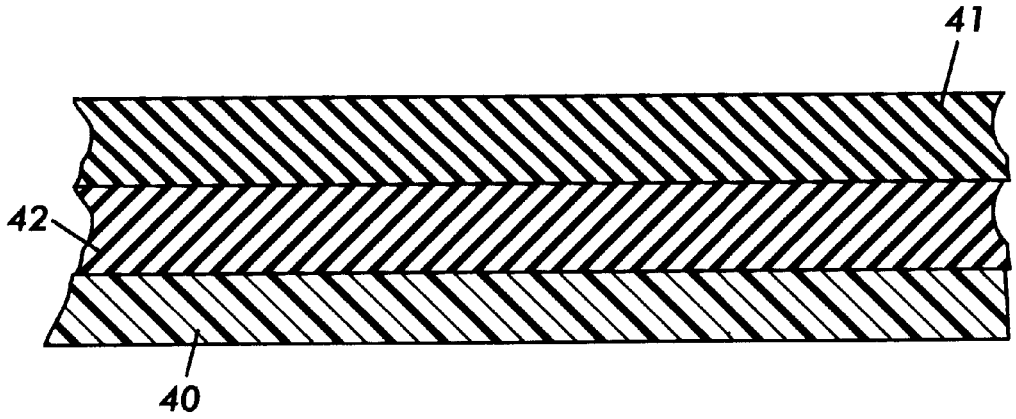
FIG. 5 is an illustration of an embodiment of the invention, wherein a three layer transfer film having a substrate, an adhesive intermediate layer and an outer polyphenylene sulfide layer as described herein is shown.

In another preferred embodiment of the invention, the transfer member is of a three layer configuration as shown in FIG. 5. This three layer configuration provides superior conformability and is suitable for use with liquid toner, and especially in color xerographic machines. In this three layer configuration, the transfer member comprises a substrate 40 as defined above, and having thereon an intermediate layer 42 comprised of an adhesive, (preferably a solventless adhesive) positioned on the substrate, and an outer release layer 41 of polyphenylene sulfide. The three layer configuration works very well with liquid development and is the preferred configuration of the present invention.

In the case of a three layer configuration, very strong adhesives are required in order to prevent or reduce the occurrence of delamination, or the pulling away of the outer layer from the substrate. Delamination is caused by the excessive force due to the numerous turns of a roller, or numerous revolutions of a belt around a set of rollers during normal machine operations. It is preferable to use higher molecular weight adhesives. Typically, the higher molecular weight adhesives require dissolving in a solvent for processing. However, a problem arises when using such adhesives with solvents. First, environmental and ventilation problems arise, and also, higher costs are associated with handling of the solvents. Second, problems result from boiling the solvent during processing which leaves bubbles and flaws in the adhering surfaces. This can result in incomplete and uneven lamination of the outer layer on the adhesive surface. However, by use of solventless adhesives, the above drawbacks have been reduced or eliminated. In addition, the pull strength of the adhesive is increased by use of solventless adhesives in combination with the layers described herein, resulting in reducing or eliminating the occurrence of delamination.

Therefore, it is preferable to use solventless adhesives with the transfer members of the present invention. Solventless adhesive, as used herein, refers to materials that are liquid at room temperature (about 25° C.) and are able to crosslink to an elastic or rigid film to adhere at least two materials together. These solventless adhesive materials contain from about 0 to about 5 percent, preferably from about 0.01 to about 3 percent, and particularly preferred from about 0.01 to about 1 percent volatile or solvent material. There are several chemical classes of solventless adhesives such as epoxy, urethane, silicones, and the like. Specific examples include 100 percent solids adhesives including polyurethane adhesives from Lord Corporation, Erie, Pa., such as TYCEL® 7924 (viscosity from about 1400 to about 2000 cps), TYCEL® 7975 (viscosity from about 1200 to about 1600 cps) and TYCEL® 7276. The viscosity range of the adhesives is from about 1200 to about 2000 cps. The solventless adhesives can be activated with either heat, room temperature curing, moisture curing, ultraviolet radiation, infrared radiation, electron beam curing or any other known technique.

Use of solventless adhesives such as those identified above enables fluid systems with higher bonding strengths without the solvent problems. The pull strength of one of the preferred three layer embodiments described herein is at least about 50 ounce/inch, preferably greater than about 200 ounce/inch, and most preferably from about 300 to about 400 ounce/inch.

Figure 6:
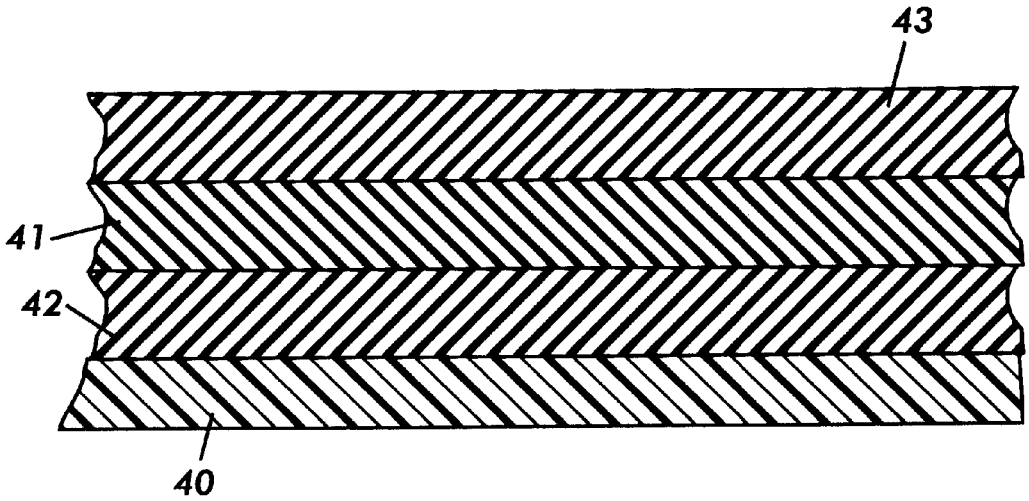
FIG. 6 is an illustration of another embodiment of the invention and demonstrates a four layer transfer configuration including a substrate, intermediate adhesive layer, outer polyphenylene sulfide layer and outer release layer.

In another embodiment, as shown in FIG. 6, the polyphenylene sulfide outer layer can include an outer release layer 43 positioned on the polyphenylene sulfide outer layer 41. Preferred outer release layers include low surface energy materials such as TEFLON®-like materials including fluorinated ethylene propylene copolymer (FEP), polytetrafluoroethylene (PTFE), polyfluoroalkoxy polytetrafluoroethylene (PFA TEFLON®) and other TEFLON®-like materials; silicone materials such as fluorosilicones and silicone rubbers such as Silicone Rubber 552, available from Sampson Coatings, Richmond, Va., (polydimethyl siloxane/dibutyl tin diacetate, 0.45 g DBTDA per 100 grams polydimethyl siloxane rubber mixture, with molecular weight of approximately 3,500); and fluoroelastomers such as those sold under the tradename VITON® such as copolymers and terpolymers of vinylidenefluoride, hexafluoropropylene and tetrafluoroethylene, which are known commercially under various designations as VITON A®, VITON E®, VITON E60C®, VITON E45®, VITON E430®, VITON B910®, VITON GH®, VITON B50®, VITON E45®, and VITON GF®. The VITON® designation is a Trademark of E.I. DuPont de Nemours, Inc. Two preferred known fluoroelastomers are (1) a class of copolymers of vinylidenefluoride, hexafluoropropylene and tetrafluoroethylene, known commercially as VITON® A, (2) a class of terpolymers of vinylidenefluoride, hexafluoropropylene and tetrafluoroethylene known commercially as VITON B®, and (3) a class of tetrapolymers of vinylidenefluoride, hexafluoropropylene, tetrafluoroethylene and a cure site monomer such as VITON GF® having 35 mole percent of vinylidenefluoride, 34 mole percent of hexafluoropropylene and 29 mole percent of tetrafluoroethylene with 2 percent cure site monomer. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known, commercially available cure site monomer.

In another preferred embodiment, the polyphenylene sulfide outer layer may be subjected to surface fluorination with fluorine gas as an alternative to the inclusion of an outer release layer. By providing the surface fluorination, or alternatively, addition of an outer low surface energy material such as those listed above, the surface energy of the polyphenylene sulfide outer coating can be reduced.

The volume resistivity of the outer polyphenylene sulfide layer of the semiconductive belt material is from about $10^5$ to about $10^{15}$, and preferably from about $10^8$ to about $10^{10}$ ohm-cm.

The circumference of the component in a film or belt configuration of from 1 to 4 or more layers, is from about 8 to about 120 inches, preferably from about 10 to about 110 inches, and particularly preferred from about 44 to about 110 inches. The width of the film or belt is from about 8 to about 40 inches, preferably from about 10 to about 36 inches, and particularly preferred from about 10 to about 30 inches. It is preferably that the film be an endless, seamed flexible belt or a seamed flexible belt, which may or may not include puzzle cut seam(s). Examples of such belts are described in U.S. Pat. Nos. 5,487,707; 5,514,436; and U.S. patent application Ser. No. 08/297,203 filed Aug. 29, 1994, the disclosures each of which are incorporated herein by reference In their entirety. A method for manufacturing reinforced seamless belts is set forth in U.S. Pat. No. 5,409,557, the disclosure of which is hereby incorporated by reference in its entirety. Other techniques which can also be used for fabricating films or belts include ultrasonic or impulse welding.

The layer or layers may be deposited on the substrate via a well known coating processes. Known methods for forming the outer layer(s) on the substrate film such as dipping, spraying such as by multiple spray applications of very thin films, casting, flow-coating, web-coating, roll-coating, extrusion, molding, or the like can be used. It is preferred to deposit the layers by spraying such as by multiple spray applications of very thin films, casting, by web coating, by flow-coating and most preferably by laminating.

The thickness of the substrates or coatings as described herein is from about 2 microns to about 125 microns, preferably from about 8 to about 75 microns, and particularly preferred about 12 to about 25 microns.

Prior to coating the outer layer on the substrate, adhesive layer or outer release layer, it is preferable to subject the surfaces to be laminated with a corona treatment. For example, in a preferred embodiment, prior to lamination with an adhesive intermediate layer, either the substrate and/or outer layer(s) are treated with corona. The pull strength can be increased 4 to 6 times as compared to no corona treatment.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Preparation of Polyphenylene Sulfide Laminate

A polyphenylene sulfide resin can be prepared by extrusion of dry pellets of polyphenylene sulfide (purchased from Toray Industries, New York, N.Y. or Phillips 66 Company, Bartlesville, Okla.) in a hot air oven or dryer at 120° C. for about 2 hours, followed by nitrogen gas purging at 250 to 290° C. in order to reduce black particles in the film. This is followed by subjecting the film to a reverse temperature profile at about 340° C. The film can then be subjected to melting at a temperature of about 300 to 310° C., followed by filtration in a 40 $\mu$m screen. The film can then be subjected to corona treatment which oxidizes and cleans the surface for improved adhesion. The film laminate can then be cast onto a roll or other substrate by any known method such as flow coating or spraying, followed by curing at a temperature of about 200° C. for up to 5 minutes. The polyphenylene sulfide can also be fabricated into a thin film sheet using typical melt processing and thin film fabrication techniques.

Example 2

Preparation of Transfer Roller with Polyphenylene Sulfide Outer Layer

Corona treated and non-corona treated aluminum rollers having the dimensions of 24 inches in width and 0.22 meters in length, respectively, were separately laminated with polyphenylene sulfide material (TORILINA® from Toray Industries, New York, N.Y.) prepared according to the procedures outlined in Example 1 to a thickness of 12 microns.

Example 3

Preparation of Two Layer Transfer Member with Polyimide Substrate and Polyphenylene Sulfide Outer Layer A two layer transfer belt was prepared by laminating the polyphenylene outer layer formed in Example 1 onto a polyimide substrate (KAPTON® available from DuPont).

Example 4

Use of Solventless Adhesives with Polyimide Substrate (TYCEL® 7975 adhesive)

A polyphenylene sulfide laminate and polyimide substrate were formed using the procedures set forth in Examples 1 and 3 above, respectively. Solventless adhesive (TYCEL® 7975-A (adhesive) and 7276 (curing agent) both from Lord Corporation, Erie, Pa.) was purchased from Lord Corporation and used to bond the polyimide substrate to the polyphenylene sulfide outer layer using known methods. The three layer material was subjected to a pull strength test conductive using an Instron 1122 mechanical tester. A load cell of 50 pounds and a cross head speed of 10 inch/minute were used for the testing. A peel test was performed using the above conditions. The pull strength was found to be about 370 ounces/inch width. This was a factor of 10 higher than the typical 7180/7200 benchmark adhesion system which demonstrated approximately 22 ounce/inch using the same test procedure.

Example 5

Use of Solventless Adhesives with Polyimide Substrate (TYCEL® 7924 adhesive)

The procedure set forth in Example 4 was repeated except that the solventless adhesive TYCEL® 7924-A (adhesive) and 7924-B (curing agent) was replaced with TYCEL® 7975 (adhesive) and 7276 (curing agent), also from Lord Corporation. The pull strength was found to be about 370 ounces/inch.

Example 6

Use of Known Adhesives with Polyimide Substrate (TYCEL® 7180)

The procedure set forth in Example 4 was again repeated except that a known (not solventless) adhesive (TYCEL® 7180 (adhesive) and 7200 (curing agent) from Lord Corporation) was used as the adhesive. The pull strength was determined to be only about 22 ounce/inch width.

Examples 4–6 demonstrate that by use of a solventless adhesive, superior results are found as compared to use of known adhesives with a polyimide substrate and polyphenylene sulfide outer layer. The pull strength increased up to 16 times as much (22 versus 370 ounce/inch) by use of the claimed solventless adhesive.

Example 7

Use of Polycarbonate Substrate with Solventless Adhesive (TYCEL® 7924)

A melt extruded polycarbonate substrate (ICI PDX91149) was purchased from Mobay Corporation. The polyphenylene sulfide as prepared in Example 1 was bonded to the polycarbonate substrate using a solventless adhesive (TYCEL® 7924-A (adhesive) and 7924-B (curing agent) both available from Lord Corporation, Erie, Pa.). The three layer material was subjected to a pull strength test. The pull strength was found to be only 138 ounces/inch width. The toughness was found to be 1,507 in-lbs/in$^3$.

Example 8

Use of Polycarbonate Substrate with Known Adhesive (TYCEL® 7180)

A three layer belt was formed as in Example 7 (polycarbonate substrate and outer polyphenylene sulfide layer) except that a known (not solventless) adhesive (TYCEL® 7180 (adhesive) and 7200 (curing agent) both available from Lord Corporation, Erie, Pa.) was used. The three layer material was subjected to a pull strength test. The pull strength was found to be only about 8 ounces/inch width.

Examples 4–8 demonstrates that superior results are found by use of the combination of polyimide substrate, solventless adhesive and outer polyphenylene sulfide layer as compared to use of polycarbonate substrate in combination with either a known adhesive or a solventless adhesive.

Example 9

Cleanability of Polyphenylene Sulfide

The polyphenylene sulfide material prepared as set forth in Example 1 was subjected to a toner cleanability test by developing a toner image on a lab sample. An air velocity nozzle was used to blow air across the sample to remove the toner. The lower the velocity needed to remove the toner demonstrates that the toner is more easily removable. The results demonstrated cleanability by PPS of about 8.8 feet/seconds which indicates better cleaning than polyimide or polycarbonate. These results demonstrate that the material as claimed performs very well as a transfer member.

Example 10

Use of Corona Treatment of Surface to be Laminated

Three layer transfer members were prepared as in Examples 4 and 5 and the substrate and outer layer were subjected to corona treatment prior to lamination. The corona treatment was provided by HR-100 at 10 volts and at $2.96\times10^5$ ohms-cm at 70° C. and at 50 percent relative humidity. The sample was then tested for pull strength and found to be from about 232 to about 348 ounce/inch width. These results demonstrate that corona treatment prior to lamination can increase pull strength.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims. All amounts are percentages by weight of total solids unless otherwise indicated.

We claim:

1. An intermediate pressure transfer or intermediate electrostatic transfer member comprising a substrate comprising a polyimide, an optional adhesive layer, and an outer layer comprising polyphenylene sulfide.

2. A transfer member in accordance with claim 1, comprising an adhesive layer positioned between said substrate and said outer layer, wherein said adhesive layer comprises a solventless adhesive.

3. A transfer member in accordance with claim 2, wherein said solventless adhesive comprises a material selected from the group consisting of epoxy resins, polyurethane resins, and silicone resins.

4. A transfer member in accordance with claim 2, wherein said solventless adhesive comprises from about 0.01 to about 5 percent solvent material.

5. A transfer member in accordance with claim 2, wherein said pull strength of said outer layer of said transfer member from said adhesive layer is at least about 50 ounce/inch.

6. A transfer member in accordance with claim 1, wherein said outer layer has an initial modulus of from about 200,000 to about 750,000 PSI.

7. A transfer member in accordance with claim 2, wherein at least one of said substrate and said outer layer is subjected to corona treatment prior to lamination with said adhesive.

8. A transfer member in accordance with claim 7, wherein said polyphenylene sulfide layer is subjected to corona treatment prior to lamination with said adhesive.

9. A transfer member in accordance with claim 1, wherein said outer layer is subjected to fluorine treatment.

10. A transfer member in accordance with claim 1, further comprising an outer release layer positioned on said outer polyphenylene sulfide layer.

11. A transfer member in accordance with claim 10, wherein said outer release layer comprises a material selected from the group consisting of fluoropolymers, polyimides and silicone rubbers.

12. A transfer member in accordance with claim 11, wherein said fluoropolymer is selected from the group consisting of a) copolymers of vinylidene fluoride, hexafluoropropylene and tetrafluoroethylene; b) terpolymers of vinylidene fluoride, hexafluoropropylene and tetrafluoroethylene; and c) tetrapolymers of vinylidene fluoride, hexafluoropropylene, tetrafluoroethylene and a cure site monomer.

13. A transfer member in accordance with claim 11, wherein said fluoropolymer is selected from the group consisting of polyfluoroalkoxy polytetrafluoroethylene, polytetrafluoroethylene, and fluorinated ethylenepropylene copolymer.

14. A transfer member in accordance with claim 1, wherein said outer layer has a volume resistivity of from about $10^5$ to about $10^{15}$ ohms-cm.

15. A transfer member in accordance with claim 1, wherein said outer layer has a thickness of from about 2 to about 125 microns.

16. A transfer member in accordance with claim 1, wherein said substrate is in the form of a belt.

17. A transfer member in accordance with claim 1, wherein said substrate is present on a metal cylindrical roll.

18. A transfer member in accordance with claim 1, wherein said outer layer further comprises a filler selected from the group consisting of graphite, carbon black, boron nitride, and metal oxides.

19. A transfer member in accordance with claim 1, wherein said substrate further comprises a filler selected from the group consisting of graphite, carbon black, boron nitride, and metal oxides.

20. A transfer member in accordance with claim 10, wherein said outer release layer further comprises a filler selected from the group consisting of graphite, carbon black, boron nitride, and metal oxides.

21. The transfer member in accordance with claim 1, further comprising a heating element, wherein said transfer member is in contact with said heating element in order to effect transfix capabilities to said transfer member.

22. An image forming apparatus for forming images on a recording medium comprising:

a charge-retentive surface to receive an electrostatic latent image thereon;

a development component to apply toner to said charge-retentive surface to develop said electrostatic latent image to form a developed image on said charge retentive surface;

an intermediate transfer member to transfer the developed image from said charge retentive surface to a copy substrate, said transfer member, for transferring by pressure transfer or electrostatic transfer, comprising a substrate comprising a polyimide, an optional adhesive layer, and an outer layer comprising polyphenylene sulfide.

23. An intermediate pressure transfer or intermediate electrostatic transfer member comprising a substrate comprising a polyimide, an adhesive layer positioned thereon wherein said adhesive layer comprises a solventless adhesive, and an outer layer positioned on said adhesive layer wherein said outer layer comprises polyphenylene sulfide, and wherein at least one of said polyimide substrate and said polyphenylene sulfide outer layer are subjected to corona treatment prior to positioning said solventless adhesive between said polyimide substrate and said polyphenylene sulfide outer layer.

* * * * *